US006217737B1

(12) United States Patent
Baumann

(10) Patent No.: US 6,217,737 B1
(45) **Date of Patent: *Apr. 17, 2001**

(54) METHOD FOR FORMING A CORROSION-RESISTANT CONDUCTIVE CONNECTOR SHELL

(75) Inventor: Frederick B. B. Baumann, Claremont, CA (US)

(73) Assignee: Hirel Connectors Inc., Claremont, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/943,801

(22) Filed: Oct. 3, 1997

(51) Int. Cl.[7] ..... C25D 11/04; C25D 5/48; C23C 28/00

(52) U.S. Cl. ..... 205/172; 205/191; 205/203; 205/229; 148/276

(58) Field of Search ..... 205/203, 229, 205/184, 187, 172, 191; 148/276

(56) References Cited

U.S. PATENT DOCUMENTS

| | | | | |
|---|---|---|---|---|
| 3,683,331 | | 8/1972 | Overholser | 339/114 |
| 4,225,399 | * | 9/1980 | Tomita | 204/58 |
| 4,239,838 | * | 12/1980 | Miller et al. | 429/104 |
| 4,490,184 | * | 12/1984 | Forcht et al. | 148/6.21 |
| 4,968,389 | | 11/1990 | Satoh et al. | 204/15 |
| 5,232,891 | * | 8/1993 | Hormann et al. | 502/326 |

FOREIGN PATENT DOCUMENTS 9103583 3/1991 (WO) .

OTHER PUBLICATIONS

International Search Report; Dec. 12, 1998; 4 p.

* cited by examiner

*Primary Examiner*—Edna Wong
(74) *Attorney, Agent, or Firm*—Sheldon & Mak

(57) ABSTRACT

A corrosion-resistant and electrically conductive connector shell includes a shell member formed of an aluminum alloy; an anodic surface coating formed on and extending into the shell member, having an approximate thickness between 0.0008 inch and 0.0018 inch; and a conductive metal plating covering and sealing the anodic surface coating. The metal plating can be a single layer of high purity aluminum having a thickness of 0.0002 inch. Alternatively, the metal plating can include a layer of a first metal on the anodic surface coating and having a thickness of at least approximately 0.00002 inch, and a layer of a second metal such as cadmium having a thickness of approximately 0.0002 inch on the layer of first metal. Also disclosed is a method for forming a corrosion-resistant and electrically conductive connector shell including the steps of providing an aluminum alloy shell member; forming an anodic coating on and extending into the shell member; and plating a single layer of aluminum by ion vapor deposition on the anodic coating.

13 Claims, 1 Drawing Sheet

METHOD FOR FORMING A CORROSION-RESISTANT CONDUCTIVE CONNECTOR SHELL

BACKGROUND

The present invention relates to electrical connectors, and more particularly to connectors for use in corrosive environments such as are found near oceans and the like.

Electrical connectors are widely used in aircraft and other vehicles that are required to be exposed to corrosive contamination by salt spray, for example. While being otherwise desirable for low cost and light weight, connectors having aluminum outer shells have been generally rejected in high-performance applications because of rapid corrosion under exposure to salt spray environments. Conventional surface treatments have proven unsatisfactory for a number of reasons. For example:

1. Ordinary anodic coatings are easily scratched through, corrosion proceeding rapidly from even very small lesions;
2. Hard anodic coatings by themselves are porous, being ineffective for excluding corrosives;
3. All anodic coatings are non-conductive, whereas electrical conductivity is usually required;
4. Conventional paint is also non-conductive and easily scratched, and conductive paint affords less corrosion resistance than conventional paint;
5. Plated coatings by themselves are typically effective for sealing out corrosives, but are subject to scratching; and nicking resulting in rapid corrosion; and
6. Connector shells formed of corrosion-resistant steel are excessively expensive to produce and undesirably heavy; and substitution of titanium is even more expensive, being also fifty percent heavier than aluminum.

Thus there is a need for a lightweight corrosion-resistant conductive connector shell that overcomes the disadvantages of the prior art.

SUMMARY

The present invention meets this need by providing an aluminum shell having a combination of anodic and plated coatings. In one aspect of the invention, a corrosion-resistant and electrically conductive connector shell includes a shell member formed of an aluminum alloy; an anodic surface coating formed on and extending into the shell member, the anodic surface coating having a hardness of not less than $R_C$ 60; and a conductive coating covering and sealing the anodic surface coating. The term "shell" is inclusive of components thereof such as coupling ring, backshell, etc.

The anodic surface coating can have a thickness being between approximately 0.0008 inch and approximately 0.0018 inch. The hardness of the anodic surface coating can be approximately $R_C$ 72.

The conductive coating preferably includes metallic plating for high conductivity. Preferred plating is a layer of ion vapor deposited high purity aluminum and having a thickness effective for sealing the anodic coating. The layer of high purity aluminum can have a thickness of at least approximately 0.0002 inch.

Alternatively, the metallic plating can include a layer of cadmium that preferably has a thickness of at least approximately 0.0002 inch for durability and wear resistance. In a further alternative, the metallic plating can include a layer of a first metal on the anodic surface coating, and a layer of a second metal on the layer of first metal. The layer of first metal can have a thickness of at least approximately 0.00002 inch being effective for bonding the layer of second metal. In yet another alternative, the plating can include cadmium.

The connector shell can be part of a connector assembly in combination with an insulative carrier supported by the connector shell, and at least one electrical contact extending within the carrier in electrical isolation from the shell.

In another aspect of the invention, a method for forming a corrosion-resistant and electrically conductive connector shell includes the steps of:

(a) providing an aluminum alloy shell member;

(b) forming an anodic coating on and extending into the shell member; and (c) plating a sealed conductive coating on the anodic coating.

The forming step can include extending the anodic coating to a depth of at least approximately 0.0008 inch at a hardness of at least $R_C$ 60. Preferably the plating step can include ion vapor deposition of high purity aluminum to a thickness effective for sealing the anodic coating. The plating step can further include extending the high purity aluminum to a thickness of at least approximately 0.0002 inch.

Alternatively, the plating step can include plating a layer of a first metal on the anodic coating, and sealingly plating a layer of a second metal on the layer of first metal. The plating step can include extending the layer of first metal to a thickness of at least approximately 0.00002 inch and extending the layer of second metal to a thickness of at least approximately 0.0002 inch for providing a desired combination of resistance to wear and corrosion, the second metal being cadmium.

DRAWINGS

These and other features, aspects, and advantages of the present invention will become better understood with reference to the following description, appended claims, and accompanying drawings, where:

DESCRIPTION

Figure 1:
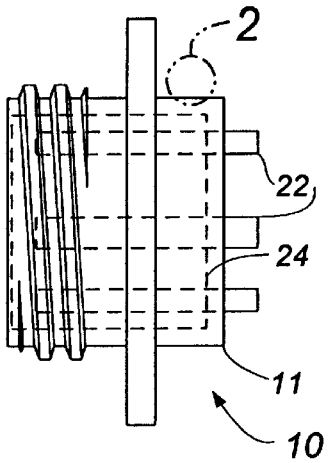
FIG. 1 is a side view of an electrical connector including a connector shell according to the present invention.
Figure 2:
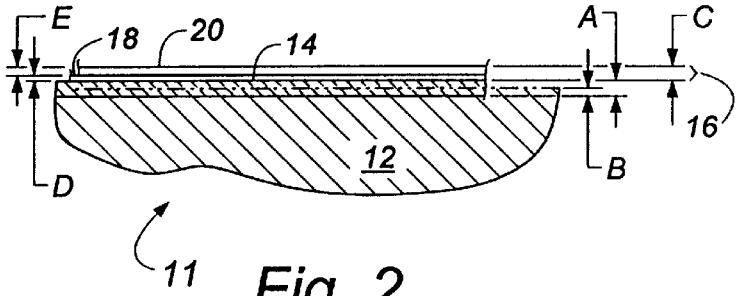
FIG. 2 is a side sectional detail view of a surface portion of the connector shell of FIG. 1.

The present invention is directed to an electrical connector shell that is particularly effective in harsh environments. With reference to FIGS. 1 and 2 of the drawings, a connector assembly 10 includes a connector shell 11 that is made from a base member 12 having an anodic coating 14 and a conductive coating 16 having a thickness C. The coating 16 can include a first plated layer 18 and a second plated layer 20. In a preferred alternative that is further described below, the conductive coating 16 can have just one layer being a sacrificial anode of ion-vapor-deposited (IVD) high purity aluminum.

The base member 12 is formed of a suitable aluminum alloy for providing a desired combination of light weight and high strength. The anodic coating 14 transforms a portion of the base member 12 at the surface thereof to a non-conductive material, the coating 14 extending slightly below the surface and also slightly enlarging the base member 12. In other words, the anodic coating 14 has a thickness A, a portion B of which extends below the original surface of the base member 12. Preferably, the anodic coating 14 is formed by a process that is commercially known as "hard anodizing" or "Type III anodizing" which produces a surface hardness of not less than $R_C$ 60 and typically $R_C$ 72, wherein the term "$R_C$" means the Rockwell C Scale as is commonly known. In contrast to conventional anodizing in which the thickness A is approximately 0.0002 inch, the thickness A using the preferred hard anodizing is between approximately 0.0008 inch and approximately 0.0018 inch, being typically approximately 0.0015 inch. The anodic coating 14 advantageously improves the durability of the connector shell 11 by providing greatly increased resistance to scraping, nicking, and wear of the base member 12. In commercial processes of hard anodizing, there typically is a supplemental treatment of immersion in heated water, dilute nitric acid, or a dichromate solution, the dichromate treatment having the effect of closing pores of the anodic coating.

A principal feature of the present invention is that the conductive coating 16 also seals microscopic voids or fissures that are normally present in the anodic coating 14, and providing a more effective seal in case of the anodic coating 14 having a supplemental treatment as described above. In the preferred configuration, the conductive coating 16 is formed as a single conductive coating of high purity aluminum being applied by ion vapor deposition (IVD) to the thickness C. The thickness C is made sufficiently great to be effective for sealing the anodic coating. Preferably the thickness C is extended to at least approximately 0.0002 inch for further protecting the base member 12.

The exemplary configuration of the conductive coating 16 has the thickness C including a thickness D of the first plated layer 18 and a thickness E of the second plated layer 20 as further shown in FIG. 2. The second plated layer 20 is formed of a metal having suitable characteristics of conductivity, corrosion resistance and wear resistance, such as cadmium. Other suitable materials for the second plated layer include zinc. The first plated layer 18 is provided when needed as a transitional material between the anodic coating 14 and the second plated material, such as for mechanical bonding and/or resistance to electrolytic corrosion. In one tested implementation wherein the second plated layer 20 is formed of cadmium, the first plated layer 18 is formed of nickel, for preventing electrolytic corrosion and for securely anchoring the second plated layer 20. The first plated layer 18 can be formed by electroless plating, this process being dictated by the nonconductive property of the anodic coating 14, and advantageously resulting in penetration of the microscopic fissures therein to provide electrical continuity between the base member 12 and the conductive coating 16. The thickness D of the first plated layer 18 is preferably not less than approximately 0.00002 inch for providing effective isolation of the second plated layer 20 from the base member 12. Tests of the configuration wherein the first plated layer 18 is nickel and the second layer 20 is cadmium, some dissolving of the anodic coating 14 was observed, indicating that a desired effectiveness of the conductive coating 16 may depend on an initial formation of the anodic coating 14 to an augmented thickness. Other suitable materials for the first plated layer 18 include IVD deposited aluminum.

Figure 3:
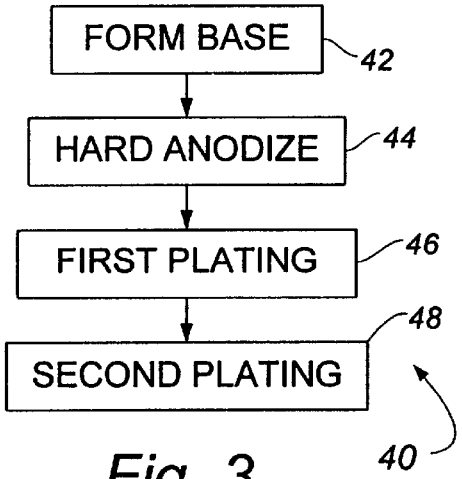
FIG. 3 is a flow diagram of a process for forming the connector shell of FIG. 1.

FIG. 3 shows a process 40 for producing the connector shell 11, including a form base step 42 for forming the base member 12, a hard anodize step 44 for forming the anodic coating 14, a first plating step 46 for forming the first plated layer 18, and a second plating step 48 for forming the second plated layer 20. In the form base step 42, the base member 12 can be machined, die cast, forged, or produced by any combination of these and other well known processes whereby the surface is not excessively rough. In the hard anodize step 44, no particular restrictions are needed, although it is preferred to include a supplemental treatment such as dipping in a dichromate solution for sealing pores of the coating 14. In the first plating step 46, it is preferred that particular care be taken to insure complete coverage, such as by tumbling or the like in an electroless bath. The second plating step 48 can be by conventional electroplating. In the preferred configuration having the single layer of high purity aluminum, the second plating step 48 is omitted.

A further shown in FIG. 1, the connector shell 11 forms a principal component of the connector assembly 10 having one or more electrical contacts 22, an insulative carrier 24, and other components that are customary or otherwise known in the electrical connector arts.

Thus the connector shell 11 and connector assemblies made therefrom exhibit a desired combination of strength, light weight and low cost resulting from the use of aluminum, durability and wear resistance as imparted by the anodic coating 14, and a combination of electrical conductivity and corrosion resistance resulting from the metallic plating that permeates microscopic fissures that can exist in the anodic coating 14.

Although the present invention has been described in considerable detail with reference to certain preferred versions thereof, other versions are possible. For example, the conductive coating 16 can be formed by direct application of any suitable sacrificial coating to the surface of the anodic coating 14. Therefore, the spirit and scope of the appended claims should not necessarily be limited to the description of the preferred versions contained herein.

What is claimed is:

1. A method for forming a corrosion-resistant and electrically conductive connector shell, comprising the steps of:

(a) providing an aluminum alloy shell member;

(b) forming an anodic coating on and extending into the shell member using a hard anodizing process wherein the coating extends a depth of at least 0.0008 inch and having a hardness of at least $R_C$ 60; and (c) plating a sealed corrosion-resistant and electrically conductive coating on the anodic coating.

2. The method of claim 1, wherein the forming step further comprises a supplemental dichromate treatment.

3. The method of claim 1, wherein the plating step comprises ion vapor deposition of high purity aluminum to a thickness effective for sealing the anodic coating.

4. The method of claim 3, wherein the plating step further comprises extending the high purity aluminum to a thickness of at least approximately 0.0002 inch.

5. The method of claim 1, wherein the plating step comprises:

(i) plating a layer of a first metal on the anodic coating; and (ii) sealingly plating a layer of a second metal on the layer of first metal.

6. The method of claim 5, wherein the step of plating the layer of the first material further comprises extending the layer of first metal to a thickness of at least approximately 0.00002 inch and the step of sealingly plating further comprises extending the layer of second metal to a thickness of at least approximately 0.0002 inch, the second metal comprising a material selected from the group consisting of cadmium and zinc.

7. The method of claim 1, wherein the plating step (c) comprises:

(i) ion vapor depositing a layer of high purity aluminum on the anodic coating to a thickness sufficient to provide electrical continuity; and (ii) sealingly plating a layer of a second metal on the layer of aluminum, the layer of second metal having a thickness of at least approximately 0.0002 inch.

8. The method of claim 7, wherein the depositing step comprises extending the high purity aluminum to a thickness of at least approximately 0.00002 inch for isolating the layer of second metal from the shell member.

9. The method of claim 1, wherein the plating step (c) comprises:

(i) plating a first layer of metal on the anodic coating; and (ii) sealingly plating a second layer of metal on the first layer of metal.

10. The method of claim 9, wherein the step of plating the first layer of metal is by electroless plating or ion vapor deposition.

11. The method of claim 9, wherein the step of plating the second layer of metal is by electroplating.

12. The method of claim 11, wherein the electroplating is to a thickness of at least approximately 0.0002 inch.

13. The method of claim 1, wherein the plating step (c) includes plating with at least one metal selected from the group consisting of aluminum, nickel, cadmium and zinc.

* * * * *